US008117850B2

(12) United States Patent
Oomen et al.

(10) Patent No.: US 8,117,850 B2
(45) Date of Patent: Feb. 21, 2012

(54) REFRIGERATION APPARATUS HAVING WARM CONNECTION ELEMENT AND COLD CONNECTION ELEMENT AND HEAT PIPE CONNECTED TO CONNECTION ELEMENTS

(75) Inventors: Marijn Pieter Oomen, Erlangen (DE); Peter van Hasselt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 1102 days.

(21) Appl. No.: 11/956,923

(22) Filed: Dec. 14, 2007

(65) Prior Publication Data

US 2008/0148756 A1 Jun. 26, 2008

(30) Foreign Application Priority Data

Dec. 14, 2006 (DE) ..... 10 2006 059 139

(51) Int. Cl.
*F25B 9/00* (2006.01)

(52) U.S. Cl. ..... 62/6; 62/51.1; 62/259.2

(58) Field of Classification Search ..... 62/6, 259.2, 62/51.1, 52.1, 383; 165/104.21
See application file for complete search history.

(56) References Cited

U.S. PATENT DOCUMENTS

| | | | | |
|---|---|---|---|---|
| 3,719,051 | A * | 3/1973 | Malaker | 62/6 |
| 5,396,206 | A | 3/1995 | Herd et al. | |
| 5,430,423 | A | 7/1995 | Herd et al. | |
| 2005/0150242 | A1 | 7/2005 | Frank et al. | |

FOREIGN PATENT DOCUMENTS

| | | |
|---|---|---|
| DE | 102 11 568 B4 | 1/2004 |
| EP | 0 696 380 B1 | 7/1999 |

* cited by examiner

*Primary Examiner* — Melvin Jones
(74) *Attorney, Agent, or Firm* — Staas & Halsey LLP

(57) ABSTRACT

A heat pipe arranged between warm and cold connection elements is intended to be filled at least partially with a refrigerant, which can be circulated in the heat pipe by a thermosiphon effect. The parts of a device, particularly in superconducting technology, which are to be cooled are connected to the warm connection element and a heat sink is connected to the cold connection element. To thermally separate the warm and cold connection elements, the refrigerant can be pumped off through the pipeline connected to the interior of the heat pipe.

16 Claims, 6 Drawing Sheets

REFRIGERATION APPARATUS HAVING WARM CONNECTION ELEMENT AND COLD CONNECTION ELEMENT AND HEAT PIPE CONNECTED TO CONNECTION ELEMENTS

CROSS REFERENCE TO RELATED APPLICATIONS

This application is based on and hereby claims priority to German Application No. 10 2006 059 139.9 filed on Dec. 14, 2006, the contents of which are hereby incorporated by reference.

BACKGROUND

Described below is a refrigeration apparatus having at least

- a warm connection element, which is thermally connected to parts of a device which are to be cooled,
- a cold connection element, which is thermally connected to a heat sink,
- a heat pipe made of a material with low thermal conductivity, which is connected at a first end to the warm connection element and at a second end to the cold connection element and whose interior is filled at least partially with a refrigerant which can be circulated by a thermosiphon effect.

A refrigeration apparatus having the aforementioned features is disclosed, for example, by DE 102 11 568 B4.

Refrigeration systems, for example refrigeration systems for superconducting magnets, often utilize so-called bath cooling. A liquid refrigerant, for example helium, with a temperature of typically 4.2 K may be used for such bath cooling. However, large amounts of the corresponding refrigerant are required for bath cooling. In the case of a superconducting magnet, there is also the possibility that it will lose its superconducting properties, for example by exceeding a critical current or a critical magnetic field for the corresponding superconductive material. In such a case, a large amount of heat is developed in a short time by the superconductive material. In the case of bath cooling, the heat given off causes the refrigerant inside the cryostat to boil. Any gaseous refrigerant given off in large amounts leads to a rapid increase of the pressure inside the cryostat.

In order to counter this problem and at the same time reduce the costs for the refrigerant, cooling systems without a refrigerant bath have been designed. Such cooling systems can make do without any refrigerant. The refrigerating power is in this case introduced into the regions to be cooled merely by solid-state thermal conduction. In such a cooling system, the regions to be cooled may be connected to a refrigeration machine by a so-called solid-state cryobus, for example made of copper. Another option involves connecting the regions to be cooled and the refrigeration machine to a closed pipeline system, in which a small amount of refrigerant circulates. The advantage of such cooling systems without a refrigerant bath is furthermore that they are easier to adapt to mobile loads to be cooled, than cooling systems which have a refrigerant bath are. Cooling systems without a refrigerant bath are therefore suitable in particular for superconducting magnets of a so-called gantry, such as is used in ion radiation therapy for combating cancer. In the cooling system described above, the refrigerating power may be provided by a refrigeration machine having a cold head, in particular a Stirling refrigerator.

A superconducting magnet, in which a cold head is directly connected mechanically and thermally by its second stage to the holding structure of a superconducting magnet winding, is disclosed for example by U.S. Pat. No. 5,396,206. In the case of the aforementioned superconducting magnet, the required refrigerating power is introduced directly into the superconducting magnet windings by solid-state thermal conduction. If however it is necessary to replace a cold head, for example for maintenance purposes, then the aforementioned cooling equipment presents a critical technical problem for a superconducting magnet. During the replacement process, air or other gases may freeze solid on the very cold contact surface, in this case the holding structure of the superconducting windings. Ice formed at these positions leads to a poor thermal connection of the subsequently reused cold head to the holding structure of the winding.

In order to prevent gases from freezing solid on the very cold contact surfaces, these may be heated to about room temperature. The effect of this is generally that all the parts of a device which are to be cooled, for example the entire superconducting windings of a magnet, must be brought to room temperature before the cold head can be replaced. Particularly for large systems, such a heating phase and the subsequent cooling phase may take a long time. This leads to long downtimes of the system. The heating and cooling phases furthermore lead to great consumption of energy.

As an alternative, the freezing of ambient gases on the very cold contact surfaces may be avoided by deliberately flooding the space around these contact surfaces with gas. This is elaborate, however, and leads to great consumption of flushing gas or refrigerant evaporated for this purpose.

EP 0 696 380 B1 discloses a superconducting magnet with a refrigerant-free refrigeration apparatus. The disclosed refrigeration apparatus has a heat bus made of a material with high thermal conductivity, for example copper, which is connected to the superconducting magnet. The heat bus can furthermore be connected to two cold heads. The two cold heads are arranged symmetrically with respect to the heat bus. They can respectively be brought onto the heat bus from opposite sides. In this way, one or both cold heads can be brought in thermal contact with the heat bus. The refrigerating power is correspondingly introduced from one or both cold heads into the heat bus.

In order to replace one of the two cold heads of the aforementioned apparatus, it may be mechanically retracted from the heat bus so that the corresponding cold head is likewise thermally separated from the heat bus. In this case, the refrigerating power is provided merely by the one remaining cold head. The retracted cold head may now be replaced without the superconducting magnet having to be heated. In the refrigeration apparatus disclosed in EP 0 696 380 B1, however, the cold heads must be rendered mechanically mobile, which requires a multiplicity of low-temperature compatible movable components and a corresponding, possibly error-prone, mechanism.

DE 102 11 568 B4 discloses a refrigeration apparatus having two cold heads which are connected via a pipeline system, in which a refrigerant can be circulated by a thermosiphon effect, to the parts of a device which are to be cooled. The pipeline system has a bifurcation. On each of the ends of the branches, there is a refrigerant space which is respectively connected to a cold head. Driven by gravity, liquid refrigerant flows down from one of these refrigerant spaces to the parts of the device which are to be cooled, where the thermal transfer takes place. Gaseous refrigerant rises back through the pipeline system to the two cold heads, where it is reliquefied. Such a cycle of the refrigerant can take place in the pipeline system both in the event that only one cold head is operating, and in the event that both cold heads are operating. If the refrigeration apparatus is dimensioned so that even a single cold head can deliver the refrigerating power needed for the parts of the device which are to be cooled, then the other (second) cold head may be replaced during continuous operation of the refrigeration apparatus. In order to minimize thermal losses, the pipeline system is made of a material with low thermal conductivity between the bifurcation and the refrigerant spaces, each of which is connected to a cold head. In this way, the losses due to solid-state thermal conduction in the branches between the bifurcation and the respective refrigerant space can be limited. Some gaseous refrigerant, however, will still also rise to the point where there is no cold head, or a cold head which is switched off. Thus, although the losses due to solid-state thermal conduction can be limited, the losses which are due to recirculating refrigerant cannot.

SUMMARY

An aspect is to provide a refrigeration system in which the parts of a device which are to be cooled are connected to a heat sink by a heat pipe, in which a refrigerant can be circulated by a thermosiphon effect, the intention being that the parts of the device which are to be cooled can substantially be decoupled thermally from the heat sink without mechanical separation.

The heat exchange between the heat sink and the parts of a device which are to be cooled takes place essentially through the refrigerant which can be circulated by a thermosiphon effect in the heat pipe. In order to thermally separate the heat sink from the parts of the device which are to be cooled, the heat pipe can be pumped off through a pipeline connected to its interior. The heat pipe should at the same time be made of a material with poor thermal conductivity. By these measures, the thermal connection between the heat sink and the parts of the device which are to be cooled is reduced to an extent defined by the solid-state thermal conductivity of the heat pipe.

Accordingly, the refrigeration apparatus contains a warm connection element which is thermally connected to parts of a device which are to be cooled, and the refrigeration apparatus is furthermore to contain a cold connection element which is thermally connected to a heat sink. A heat pipe made of a material with low thermal conductivity is to be connected at a first end to the warm connection element and at a second end mechanically releasably to the cold connection element. The interior of the heat pipe is to be filled at least partially with a refrigerant which can be circulated by a thermosiphon effect. The refrigeration apparatus is furthermore to include a pipeline, which is connected at a first end to the interior of the heat pipe. In order to thermally separate the connection elements, it should be possible to pump off the refrigerant from the heat pipe through the pipeline. It should furthermore be possible to heat the cold connection element by a heater.

The advantages of a refrigeration apparatus having the aforementioned features are above all that thermal transmission through the heat pipe is significantly reduced by pumping off the refrigerant from the interior of the heat pipe. In this way, the parts of a device which are to be cooled can be substantially decoupled thermally from the heat sink without requiring a second heat sink, and without one or more heat sinks needing to be mechanically moved. If the heat sink, which is connected mechanically releasably to the cold connection element, is removed from the refrigeration apparatus, then the cold connection element can be heated within a short time by the heater so that, in particular, air or other gases contained in the ambient atmosphere can freeze only to a small extent on the surface of the cold connection element. Ice formation on the contact surfaces between the cold connection element and the heat sink can thereby mostly be avoided. Owing to the reduced ice formation, the thermal contact when the heat sink is reused turns out to be much better than in the case when significant ice formation takes place on the contact surfaces. The cryogenic region, in which the parts of the device which are to be cooled lie, remains protected against heat fluxes entering this region owing to the thermal decoupling. In this way, the parts of a device which are to be cooled remain at the desired low temperature even when the heat sink is being replaced. With the aforementioned measures, a refrigeration apparatus can be provided which makes it possible to switch off, replace, carry out maintenance on or temporarily remove the heat sink without it being necessary to heat the parts to be cooled, even when using a single heat sink. The refrigeration apparatus described below is suitable in particular for devices in the field of a superconducting technology.

Accordingly, the refrigeration apparatus may also have the following features:

- The refrigerant may be present as a two-phase mixture. In particular, the refrigerant may be present as a two-phase mixture consisting of a liquid phase and a gaseous phase. In this way, the latent heat of the liquid-gaseous phase transition can advantageously be used better to improve the thermal coupling between the cold and warm connection elements via the heat pipe. Gaseous refrigerant is in this case condensed at the end of the heat pipe which is connected to the cold connection element, while liquid refrigerant evaporates at the end of the heat pipe which is connected to the warm connection means.
- The pipeline may be configured so that at least parts of the pipeline lie geodetically higher than the liquid level of the refrigerant. A configuration of the heat pipe as described above can prevent liquid refrigerant from traveling through the pipeline to a point at which the pipeline is connected to the outer, optionally warm part of the refrigeration apparatus. Unnecessary heat input into the cryogenic region, particularly into the heat pipe, can be avoided in this way.
- The parts of the device which are to be cooled may be arranged in an evacuable cryostat and the second end of the pipeline may lie outside the cryostat. Very cold parts of a device can advantageously be insulated thermally from their environment by an evacuable cryostat. Such thermal insulation constitutes effective insulation for very cold parts of a device. Particularly in the case of such very cold parts of a device, it is desirable to avoid ice formation on the contact surfaces of the cold connection element. The use of a refrigeration apparatus according to the exemplary embodiment above is therefore advantageous for equipment having very cold parts.
- A multi-stage refrigeration machine with a first stage and a second stage may be provided, in which case the heat sink may be formed by the second stage and the first stage may be connected mechanically releasably to a heat shield arranged inside the cryostat. A multi-stage refrigeration machine is suitable for very cold parts of a device which are to be cooled. A heat shield may advantageously be used as a further measure for thermal insulation. The thermal separation of the parts of the device which are to be cooled from the second stage of the refrigeration machine is advantageous since the benefit of thermal separation without moving parts is profited from particularly in the case of mechanically complex cooling systems.
- At least parts of the refrigeration machine may be accommodated replaceably in an evacuable maintenance space separated from the evacuable cryostat. With the aid of a further, likewise evacuable maintenance space separated from the evacuable cryostat, the process of replacing the refrigeration machine can be carried out without the vacuum of the cryostat needing to be broken. The maintenance process is thereby rendered particularly simple and effective.

The refrigeration apparatus may be rotatable about an axis which extends essentially parallel to a symmetry axis of the heat pipe. The heat pipe may furthermore have a larger cross section in a first region, which is connected to the warm connection element, than in a second region which is connected to the cold connection element. The parts of the heat pipe which connect the first region and the second region to one another may be configured so that any refrigerant condensed in the second region can enter the first region under the effect of gravity without impediment. A refrigeration apparatus having the features aforementioned may advantageously be used in particular for moving parts of a device which are to be cooled, and which in this case are arranged rotatably. The special configuration of the heat pipe ensures thermal contact at all times between the refrigeration machine and the parts of the device which are to be cooled, even with rotation of the parts of a device which are to be cooled.

The pipeline may be connected at its ends near the symmetry axis to the heat pipe and to the outside of the cryostat. The pipeline may furthermore have at least one intermediate region near the axis in its lengthwise direction. With a configuration of the pipeline as described above, during rotation of the parts of a device which are to be cooled it is possible to prevent the refrigerant from traveling through the pipeline to the warm end of the pipeline, which is fastened outside the cryostat. In this way, it is possible to prevent the refrigerant from circulating in the pipeline between the very cold region lying inside the heat pipe and the end of the pipeline which is accommodated outside the cryostat. Heat losses due to circulation of the refrigerant as described above can particularly advantageously be prevented by the configuration of the pipeline described above. The intermediate region of the pipeline may have a V-shaped profile in the direction of the axis A. A pipeline bent in a V-shape represents a particularly simple and effective configuration form of the pipeline.

The heat pipe may be designed essentially in the form of a conic frustum. Designing the heat pipe in the form of a conic frustum can provide a particularly simple, cost-efficient and effective form of the heat pipe.

The refrigeration apparatus may comprise an auxiliary cooling system, which has at least the following features: a refrigerant space connected to the cold connection element; a delivery line, through which the refrigerant space can be filled with a second refrigerant from a site placed geodetically higher outside the cryostat; a pipeline system, which is thermally connected over a large area to the parts of the device which are to be cooled and in which the second refrigerant can be circulated owing to a thermosiphon effect; an off-gas line, through which gaseous second refrigerant can escape from the pipeline system. An auxiliary cooling system having the aforementioned features can achieve an acceleration of the cooling phase, particularly when there are large masses to be cooled. Additional cooling power for the parts of a device which are to be cooled is provided by filling the refrigerant space via the delivery line with a second refrigerant from a site placed geodetically higher outside the cryostat. Any second refrigerant which may evaporate can escape from the pipeline system through the off-gas line. The formation of an overpressure in the pipeline system is thereby prevented. Inside the pipeline system, the second refrigerant may circulate by a thermosiphon effect and thus ensure effective additional cooling.

The connection elements may be formed of a material with high thermal conductivity, preferably copper. The heat pipe may consist of a material, preferably stainless steel, with a thermal conductivity lower than that of copper. Such a configuration of the connection elements made of a material with high thermal conductivity, such as copper, can achieve particularly effective thermal coupling both to the heat sink and to the parts of the device which are to be cooled. The thermal conductivity of the heat pipe is determined above all by the refrigerant circulating inside the heat pipe. If the heat pipe per se is made from a material with low thermal conductivity, for example stainless steel, then a particularly large reduction of the thermal conductivity can be achieved by pumping off the refrigerant.

The device may be gantry equipment for radiation therapy, and the parts to be cooled may be the magnets of the gantry for deflecting a particle beam. The refrigeration apparatus is particularly suitable for a gantry, since the magnets to be cooled rotated about a rotation axis of the gantry. In particular, one or more superconducting gantry magnets may advantageously be cooled by the refrigeration apparatus.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
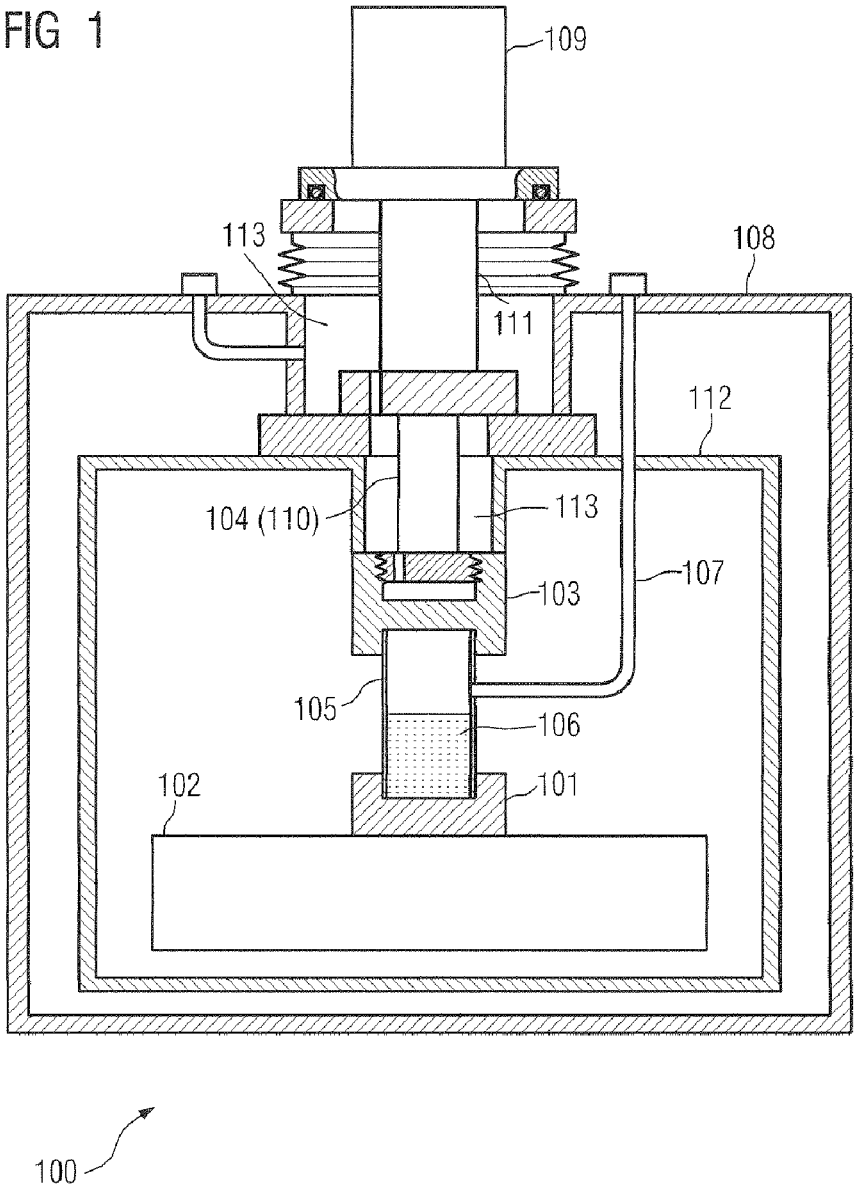
FIG. 1 is a cross section of a refrigeration apparatus.

Reference will now be made in detail to the preferred embodiments, examples of which are illustrated in the accompanying drawings, wherein like reference numerals refer to like elements throughout.

FIG. 1 shows the schematic structure of a refrigeration apparatus 100 according to an exemplary embodiment. A cryostat 108 contains the parts 102 of a device which are to be cooled. The parts 102 of the device which are to be cooled may, for example, be the magnet windings of a superconducting magnet or other parts in superconducting technology. In order to improve the thermal insulation, a heat shield 112 is accommodated inside the cryostat 108. The cooling power for the parts 102 of the device which are to be cooled is provided by a refrigeration machine 109, for example a cold head or a Stirling refrigerator. A cold head which operates according to the Gifford-McMahon principle may preferably be used. According to the present exemplary embodiment, such a two-stage refrigeration machine 109 may be thermally connected by its first stage 111 to the heat shield 112. The connection between the first stage 111 of the refrigeration machine 109 and the heat shield 112 may preferably be a releasable mechanical connection, for example a screw or clamp connection, which at the same time ensures good thermal contact of the components. The second stage 110 of the refrigeration machine 109 constitutes the actual heat sink 104 of the refrigeration apparatus 100. The second stage 110 of the refrigeration machine 109 is thermally connected to a cold connection element 103. The corresponding connection may preferably be a screw connection. This means that the refrigeration machine 109 is releasably screwed by its second stage 110 into the cold connection element 103. Any other mechanical connection which is releasable, and at the same time ensures good thermal contact between the second stage 110 of the refrigeration machine 109 and the cold connection element 103, is also suitable for the exemplary embodiment represented in FIG. 1. The connection elements 101 and 103 may likewise be a part of the parts 102 of a device which are to be cooled, or of the heat sink 104. They may furthermore be integrated into the corresponding components, or firmly connected permanently thereto.

According to the exemplary embodiment shown in FIG. 1, the refrigeration machine 109 may partially lie in a separate evacuable maintenance space 113. This maintenance space 113 is separated from the rest of the evacuable space of the cryostat 108. The cold connection element 103 is connected with good thermal conduction and preferably also mechanically to a heat pipe 105. On the opposite side, the heat pipe 105 is connected to a warm connection element 101. This connection is likewise configured with good thermal conduction, and may preferably also be a mechanical connection. The warm connection element 101 is in turn connected with good thermal conduction to the parts 102 of a device which are to be cooled. Inside the heat pipe 105, there is a refrigerant 106 which can circulate in the heat pipe 105 according to a thermosiphon effect. The heat pipe 105 per se is formed of a material with low thermal conductivity.

The heat pipe 105 may be entirely filled with the refrigerant 106. In particular, it may in this case be a gas which is used as the refrigerant 106. Owing to the temperature, the refrigerant can in this case assume a higher density in the cold upper region of the heat pipe 105 than in the warm lower region of the heat pipe 105. Owing to the density differences of the gas which result from this, a circulation by the thermosiphon effect can be set up in the heat pipe 105. This circulation causes particularly good thermal coupling between the parts 102 of the device which are to be cooled and the heat sink 104.

Furthermore, the heat pipe 105 may be filled merely partially with a refrigerant 106. In particular, the refrigerant 106 may be present as a two-phase mixture. In this case, circulation of the refrigerant 106 can be set up in the different phases, i.e. liquid-gaseous. Accordingly, gaseous refrigerant is liquefied in the part of the heat pipe 105 which is in thermal contact with the cold connection piece 103. Driven by gravity, condensed refrigerant 106 moves into the part of the heat pipe 105 represented further below in FIG. 1, which is in thermal contact with the warm connection piece 101. In this part of the heat pipe 105, the refrigerant delivers the refrigerating power to the warm connection piece 101 (and therefore also to the parts of the device which are to be cooled 102), whereupon gaseous refrigerant 106 rises back into the upper part of the heat pipe. In this case, the cold connection piece 103 acts as a condenser and the warm connection piece acts as an evaporator. In this way, a good thermal connection can be established between the refrigeration machine 109, or its second stage 110, and the parts 102 of a device which are to be cooled.

During operation of a refrigeration apparatus 100, the need may arise for a refrigeration machine 109 to be replaced, for example for maintenance work or owing to a defect. Before the refrigeration machine 109 is removed from the refrigeration apparatus 100, the refrigerant 106 which lies inside the heat pipe 105 is pumped off through a pipeline 107 leading outward. In many cases, it is sufficient to pump off the majority of the refrigerant 106 from the heat pipe 105; it may nevertheless also be fully removed from the heat pipe 105. By removing the refrigerant 106 from the heat pipe, the thermal conductivity of the heat pipe 105 is reduced considerably. Between the cold connection element 103 and the warm connection element 101, thermal conduction thereupon takes place merely owing to solid-state thermal conduction through the material of the heat pipe 105. If the heat pipe 105 is made from a material with low thermal conductivity, for example stainless steel, then the thermal conduction between the connection elements 101, 103 can be reduced to a minimum. Besides stainless steel, it is also possible to use various plastics, ceramics or other low-temperature compatible materials as materials for the heat pipe 105. A further measure for minimizing the thermal conduction is to manufacture the heat pipe 105 with particularly thin walls. The heat pipe 105 may furthermore have a small diameter and a large length. In this way, the material of the heat pipe 105 represents a particularly large thermal resistance.

After the refrigerant 106 has been pumped off from the heat pipe 105 through the pipeline 107, the maintenance space 113 may be ventilated. Owing to the ambient air flowing into the maintenance space 113, the cold connection element 103 and the previously cooled parts of the refrigeration machine 109 start to heat up. The maintenance space 103 may likewise be flooded with a special flushing gas, for example dried air, nitrogen or helium. After the maintenance space 113 has been ventilated, the refrigeration machine 109 can be removed from the refrigeration apparatus 100. The previously very cold connection element 103 is thermally decoupled from the other still very cold parts, in particular the warm connection element 101 and the parts 102 of a device which are to be cooled, and it will therefore heat up rapidly to a temperature close to room temperature. Since, as described above, the cold connection element 103 heats up by itself, ice formation due to condensing gas, preferably ambient air, is substantially avoided. When the refrigeration machine 109 is reused, a good thermal and mechanical contact is therefore ensured between its second stage 110 and the cold connection element 103.

Superconducting magnet windings are suitable in particular for irradiating apparatus, such as are used in particle therapy for example for combating cancer. Such superconducting magnet windings are preferably mounted in a so-called gantry, which can be rotated about a fixed axis.

Figure 2:
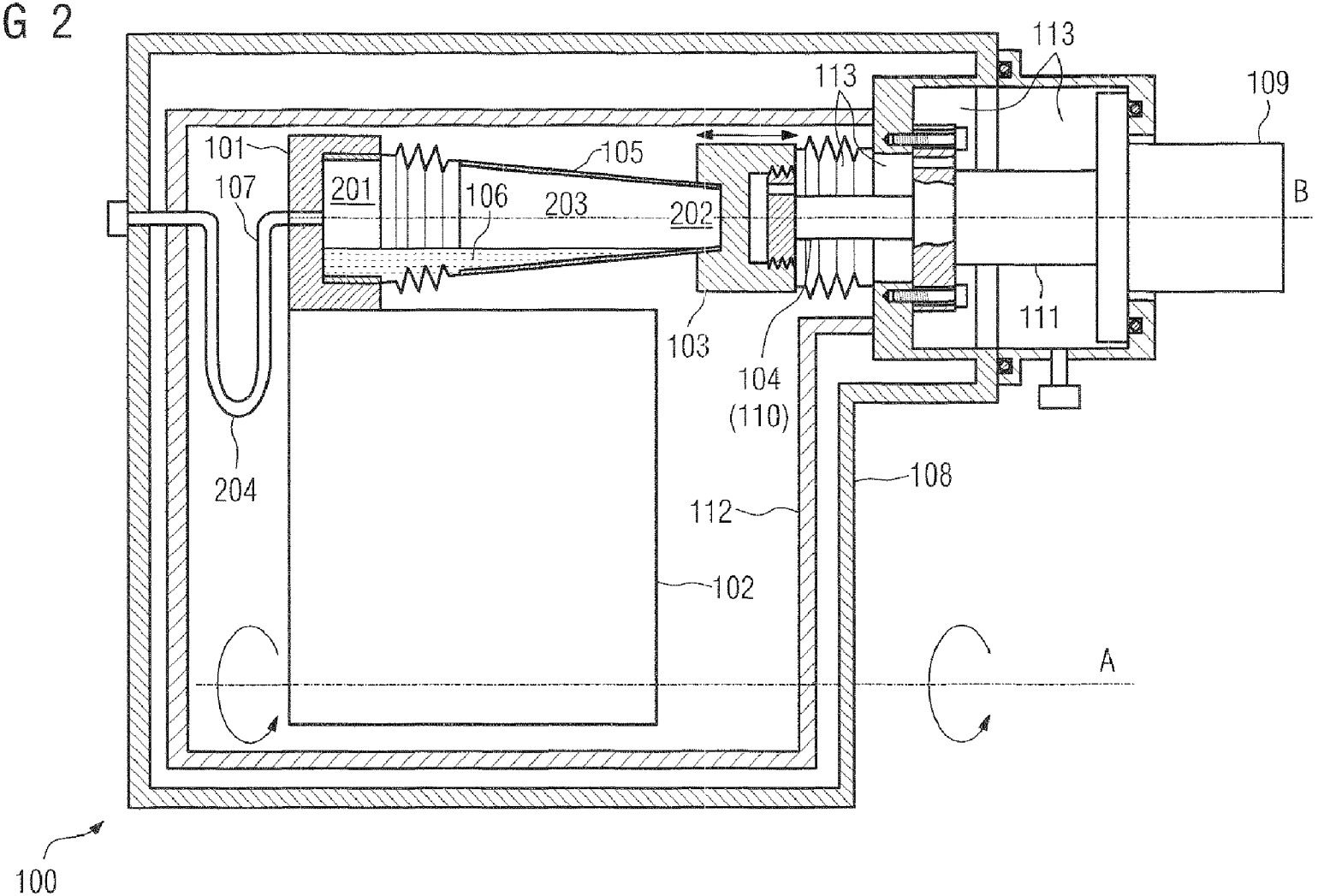
FIG. 2 is a cross section of a rotatable refrigeration apparatus.

FIG. 2 shows another exemplary embodiment of the refrigeration apparatus denoted overall by 100, the entire refrigeration apparatus 100 including the parts 102 to be cooled being arranged rotatably about an axis A. According to the embodiment of the refrigeration apparatus 100 as represented in FIG. 2, the parts 102 to be cooled are located in a cryostat 108, which additionally has a heat shield 112.

Preferably, the refrigeration machine 109 is substantially configured axisymmetrically with respect to a further axis B. The refrigeration machine 109 is accommodated in a maintenance space 113, which can be evacuated separately from the cryostat 108. The first stage 111 of the refrigeration machine 109 is connected to the heat shield 112, and the second stage 104 of the refrigeration machine 109 is connected to the cold connection element 103. Via its first part 202, the heat pipe 105 has a thermal, and preferably also mechanical connection to the cold connection element 103. A second part 201 of the heat pipe 105 is in thermal, and preferably also mechanical contact with the warm connection element 101. The first part 202 of the heat pipe 105 has a smaller cross section that the second part 201 of the heat pipe 105. The part 203 of the heat pipe 105, which connects the first part 202 and the second part 201 of the heat pipe 105, is configured so that condensed refrigerant 106 can travel owing to gravity without impediment through this part 203 from the first region 202 into the second region 201. The entire heat pipe 105 may preferably have the shape of a conic frustum closed on both sides. Such a heat pipe 105 may furthermore be connected to the refrigeration machine 109 so that the symmetry axis of the conic frustum coincides with the axis B.

In the region of this axis B, the pipeline 107 is connected to the heat pipe 105. Through this pipeline, the refrigerant 106 can be pumped off from the heat pipe 105. The refrigerant 106 may, in particular, be present in the heat pipe 105 as a two-phase mixture of liquid-gas. The pipeline 107 has a shape such that any liquid 106 entering the pipeline 107 from the heat pipe 105 can travel without impediment downward to the outer part of the pipeline 107, which is in communication with the cryostat 108. To this end, the pipeline 107 has a part 204 which is bent in the direction of the axis A. Such a configuration of the pipe 107 prevents liquid 106 from coming in constant contact with the outer part of the pipeline 107 through the pipeline, even when the entire refrigeration apparatus 100 is rotated about the axis A.

As described in connection with FIG. 1, the refrigerant 106, in particular liquid refrigerant 106, can be pumped off from the heat pipe 105 through the pipeline 107. In this way, thermal separation is achieved between the parts 102 of a device which are to be cooled and the heat sink 104. In order to be able to replace the refrigeration machine 109, for example for maintenance work, even in the case of such a refrigeration apparatus 100 rotatable about an axis A, the working space 113 is ventilated after the refrigerant 106 has been pumped off. For the case in which the heat shield 112 has a rigid connection to the cryostat 108, the parts of the working space 113 which are arranged between the flange fastening the first stage 111 of the refrigeration machine to the heat shield 112 and the condenser 103 may be configured flexibly. Such a flexible configuration may, for example, be carried out with the aid of a bellows. In order to allow separation between the second stage 110 of the refrigeration machine 109 and the condenser 103, the condenser 103 may be movable along the axis B owing to a flexible configuration of the heat pipe 105. To this end, the heat pipe 105 may likewise have a bellows.

Figure 3:
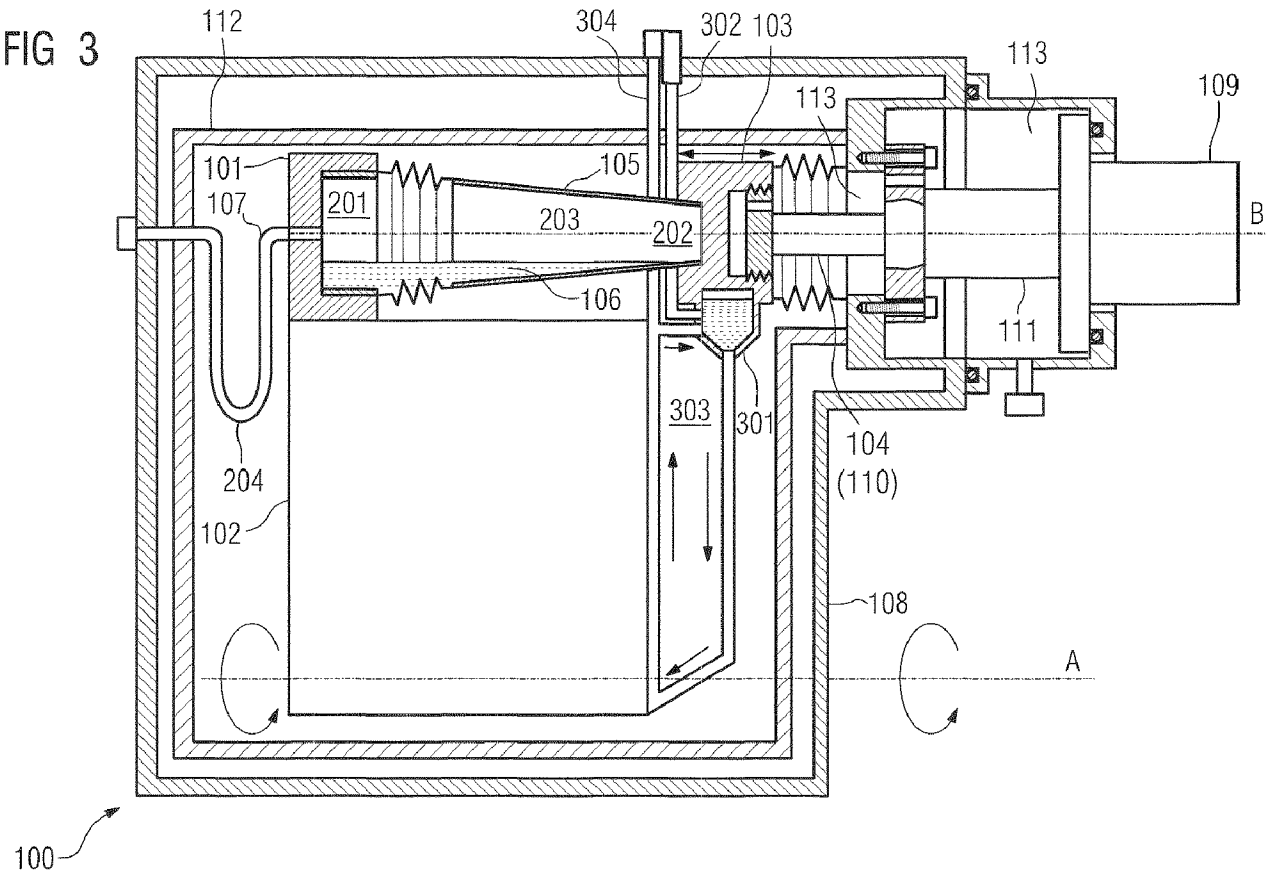
FIG. 3 is a cross section of a rotatable refrigeration apparatus with an auxiliary cooling system.

FIG. 3 shows another exemplary embodiment of a refrigeration apparatus denoted overall by 100. The refrigeration apparatus 100 represented in FIG. 3 is supplemented relative to the one represented in FIG. 2 by an additional cooling system. A refrigerant space 301 is in thermal, and preferably also mechanical, contact with the cold connection element 103. This refrigerant space 301 can be filled through a delivery line 302 from a site placed geodetically higher. The same refrigerant or a similar refrigerant as is used for the heat pipe 105 may be employed as the refrigerant. For example, helium, neon or nitrogen may be used. Connected to the refrigerant space 301, there is a pipeline system 303 which is connected over a large area to the parts 102 of a device which are to be cooled. In this way, additional refrigerating power can be delivered to the parts 102 of a device which are to be cooled. The cooling times, for example for a superconducting magnet, can thereby be reduced significantly. Any refrigerant which may evaporate in the pipeline system 303 can escape from the pipeline system 303 through an off-gas line 304. An overpressure in the pipeline system 303 is prevented in this way.

The auxiliary cooling device may, for example, be used so that the parts 102 of a device which are to be cooled are initially precooled with nitrogen, which is inexpensively and readily available, before the parts 102 to be cooled are cooled to even lower temperatures with the aid of the refrigeration machine 109. For use of the auxiliary cooling device, it is technically necessary to stop the refrigeration apparatus 100 in its possible rotation about the axis A or at least move it so slowly that a gravity-driven refrigerant circuit, which is based on a thermosiphon effect, can be set up in the pipeline system 303.

Figure 4:
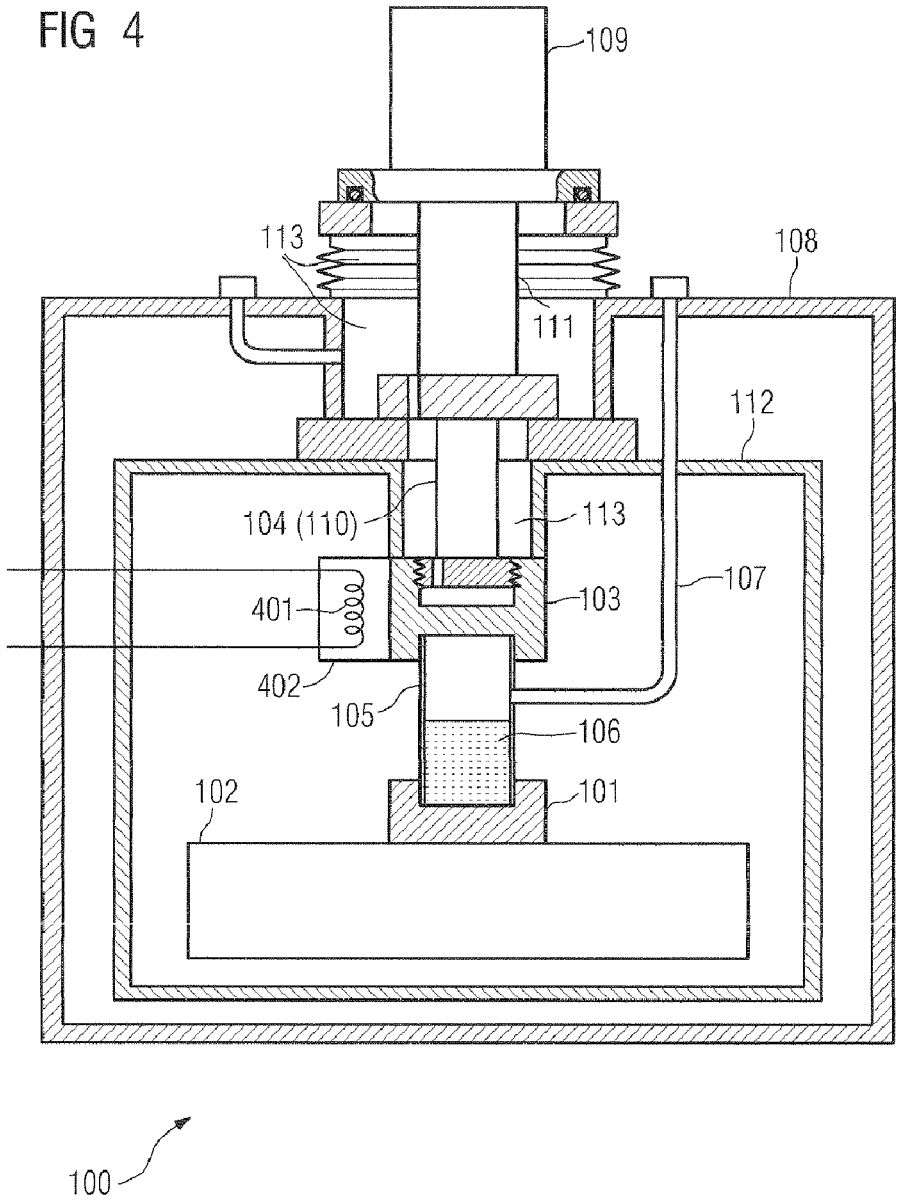
FIG. 4 is a cross section of a refrigeration apparatus, the cold connection element being heatable.

FIG. 4 shows the view of a refrigeration apparatus 100 as is generally known from FIG. 1, the cold connection element 103 additionally being connected to an element 402 which can be heated by a heater 401. If the heat pipe 105 is evacuated through the pipeline 107 when replacing the refrigeration machine 109, then thermal separation is achieved between the cold connection element 103 and the warm connection element 101. In order to prevent ambient gases from freezing on the cold connection element 103, it may be deliberately heated by the further element 402 connected to the cold connection element 103. To this end, the heater 401 is used. By heating the cold connection element 103 to a temperature close to room temperature even before the maintenance space 113 is ventilated, freezing of ambient gases can be avoided almost completely, in particular on the connection site between the heat sink 104 and the cold connection element 103. When the refrigeration machine 109 is reused, a good thermal contact can therefore be ensured between the heat sink 104 and the cold connection element 103 without any ice having to be removed.

Figure 5:
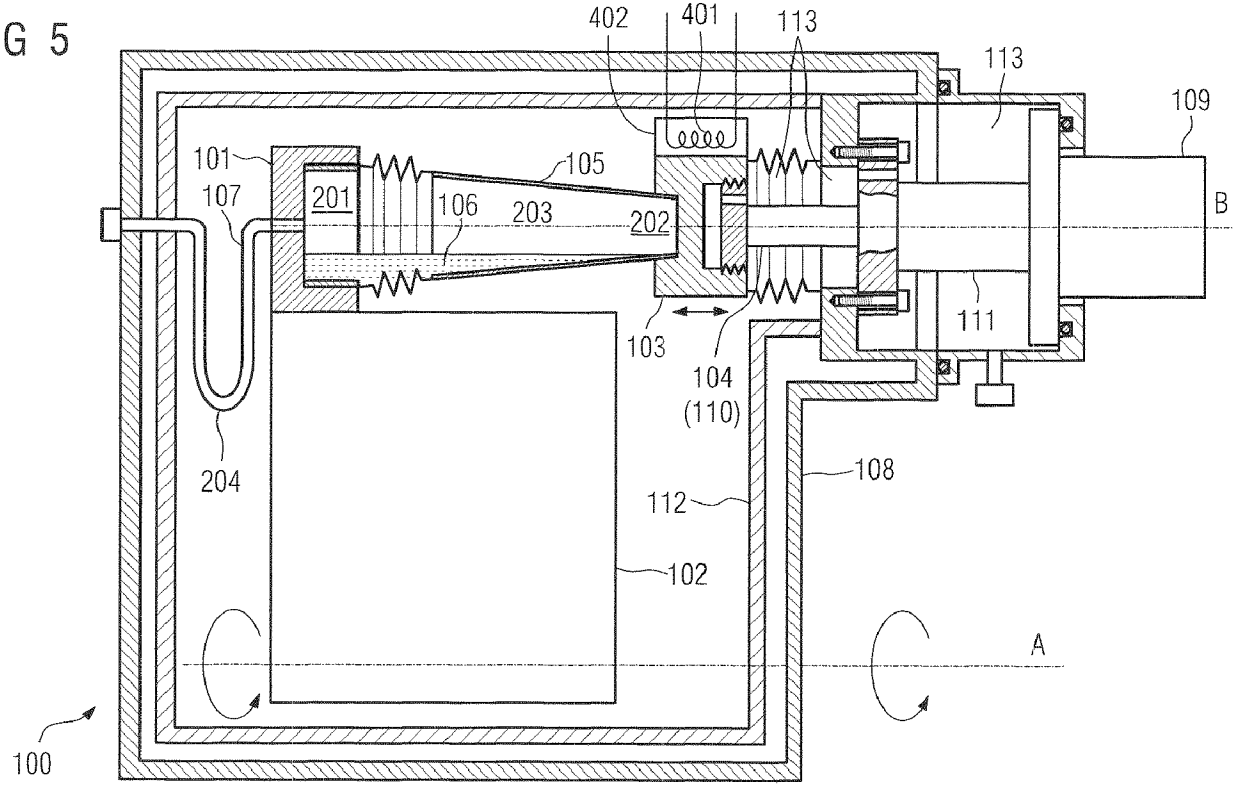
FIG. 5 is a cross section of a rotatable refrigeration apparatus, the cold connection element being heatable.
Figure 6:
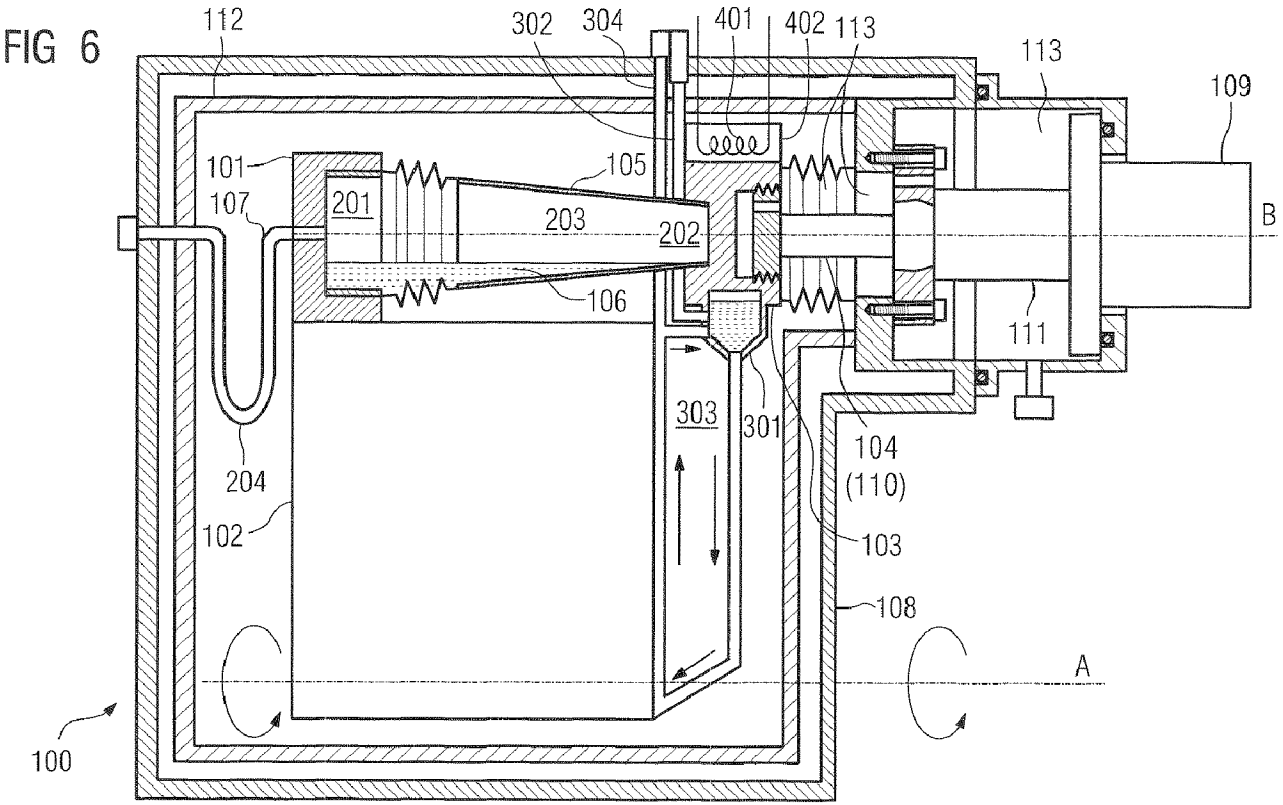
FIG. 6 is a cross section of a rotatable refrigeration apparatus with an auxiliary cooling system, the cold connection element being heatable.

FIG. 5 shows a refrigeration apparatus 100 as is generally known from FIG. 2. In the refrigeration apparatus 100 represented in FIG. 5, the cold connection element 103 is connected to a further element 402 which can be heated by a heater 401. FIG. 6 likewise shows a refrigeration system 100 as is generally known from FIG. 3. In this refrigeration apparatus 100 as well, the cold connection element 103 can be heated by a heater 401, or the element 402 connected to the heater. As explained in connection with FIG. 4, freezing of ambient gases, in particular at the connection site between the heat sink 104 and the cold connection element 103, can also be prevented in the refrigeration apparatus 100 as represented in FIGS. 5 and 6.

The system also includes permanent or removable storage, such as magnetic and optical discs, RAM, ROM, etc. on which the process and data structures of the present invention can be stored and distributed. The processes can also be distributed via, for example, downloading over a network such as the Internet. The system can output the results to a display device, printer, readily accessible memory or another computer on a network.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

What is claimed is:

1. A refrigeration apparatus, comprising:

a warm connection element thermally connected to parts of a device which are to be cooled;

a cold connection element thermally connected to a heat sink;

a heat pipe, made of a material with low thermal conductivity, connected at a first end to the warm connection element and at a second end mechanically releasably to the cold connection element and having an interior filled at least partially with a refrigerant which can be circulated by a thermosiphon effect;

a pipeline connected at a first end to the interior of the heat pipe , the refrigerant being pumped off through the pipeline to thermally separate the connection elements; and a heater heating the cold connection element when desired.

2. The refrigeration apparatus as claimed in claim 1, wherein the refrigerant is a two-phase mixture.

3. The refrigeration apparatus as claimed in claim 2, wherein the pipeline has at least parts geodetically higher than a liquid level of the refrigerant.

4. The refrigeration apparatus as claimed in claim 3, wherein the parts of the device which are to be cooled are arranged in an evacuable cryostat and a second end of the pipeline lies outside the cryostat.

5. The refrigeration apparatus as claimed in claim 4, wherein, the cryostat includes a heat shield, and said refrigeration apparatus further comprises a multistage refrigeration machine with a first stage and a second stage, the heat sink being formed by the second stage and the first stage being connected mechanically releasably to the heat shield arranged inside the cryostat.

6. The refrigeration apparatus as claimed in claim 5, wherein at least parts of the multistage refrigeration machine are accommodated replaceably in an evacuable maintenance space separated from the evacuable cryostat.

7. The refrigeration apparatus as claimed in claim 6, wherein rotatability is provided about a rotation axis which extends essentially parallel to a symmetry axis of the heat pipe, and wherein the heat pipe has a larger cross section in a first region, connected to the warm connection element, than in a second region connected to the cold connection element, and the parts of the heat pipe which connect the first region and the second region to one another are configured so that any refrigerant condensed in the second region can enter the first region under the effect of gravity without impediment.

8. The refrigeration apparatus as claimed in claim 7, wherein the pipeline is connected at the first and second ends near the symmetry axis to the heat pipe and to the outside of the cryostat, respectively, and the pipeline has at least one intermediate region near the rotation axis in a lengthwise direction thereof.

9. The refrigeration apparatus as claimed in claim 8, wherein the at least one intermediate region in the lengthwise direction of the pipeline has a V-shaped bend in the lengthwise direction of the rotation axis .

10. The refrigeration apparatus as claimed in claim 9, wherein the heat pipe is formed essentially as a conic frustum.

11. The refrigeration apparatus as claimed in claim 10, further comprising an auxiliary cooling system, comprising a refrigerant space connected to the cold connection element;

a delivery line through which the refrigerant space can be filled with a second refrigerant from a portion of the delivery line geodetically higher than the refrigerant space and disposed outside the cryostat;

a pipeline system, thermally connected over a large area to the parts of the device which are to be cooled and in which the second refrigerant can be circulated owing to a thermosiphon effect; and an off-gas line, through which gaseous second refrigerant can escape from the pipeline system.

12. The refrigeration apparatus as claimed in claim 11, wherein the warm and cold connection elements are formed of a first material with high thermal conductivity, including copper.

13. The refrigeration apparatus as claimed in claim 12, wherein the heat pipe is formed of a second material, including stainless steel, with a thermal conductivity lower than that of the first material.

14. The refrigeration apparatus as claimed claim 13, wherein the device contains superconducting parts.

15. The refrigeration apparatus as claimed in claim 14, wherein the device is gantry equipment for radiation therapy.

16. The refrigeration apparatus as claimed in claim 15, wherein the parts to be cooled are superconducting magnets deflecting a particle beam.

* * * * *